US008870039B2

(12) United States Patent
Bellmore et al.

(10) Patent No.: US 8,870,039 B2
(45) Date of Patent: Oct. 28, 2014

(54) TAP

(71) Applicant: Scholle Corporation, Irvine, CA (US)

(72) Inventors: David Bellmore, Aurora, IL (US); Richard L Albiani, Westchester, IL (US)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 13/786,394

(22) Filed: Mar. 5, 2013

(65) Prior Publication Data

US 2013/0306684 A1 Nov. 21, 2013

Related U.S. Application Data

(63) Continuation of application No. 12/769,115, filed on Apr. 28, 2010, now Pat. No. 8,387,837.

(51) Int. Cl.

| | |
|---|---|
| ***B67D 7/06*** | (2010.01) |
| ***B67D 3/00*** | (2006.01) |
| ***B67D 3/04*** | (2006.01) |

(52) U.S. Cl.

CPC ..... *B67D 3/0058* (2013.01); *B67D 3/043* (2013.01)

USPC ..... 222/505

(58) Field of Classification Search

USPC ..... 222/509, 542, 559, 105, 571, 505, 566, 222/129.1, 521, 554, 563, 481, 482, 575

See application file for complete search history.

(56) References Cited

U.S. PATENT DOCUMENTS

| | | | | | |
|---|---|---|---|---|---|
| 2,731,925 | A | * | 1/1956 | Carvel | 425/207 |
| 3,058,631 | A | * | 10/1962 | De La Hitte | 222/507 |
| 3,369,707 | A | * | 2/1968 | Porter et al. | 222/83 |
| 3,489,323 | A | * | 1/1970 | Hug | 222/402.16 |
| 4,619,377 | A | * | 10/1986 | Roos | 222/83 |
| 6,045,119 | A | | 4/2000 | Erb | |
| 6,065,651 | A | * | 5/2000 | Tedeschi et al. | 222/519 |
| 6,135,329 | A | * | 10/2000 | Stoneberg et al. | 222/521 |
| 6,296,157 | B1 | | 10/2001 | Erb | |
| 6,409,055 | B1 | * | 6/2002 | Officier | 222/559 |
| 6,978,981 | B2 | * | 12/2005 | Roos | 251/334 |
| 6,983,863 | B2 | * | 1/2006 | Santy, Jr. | 222/129.1 |

(Continued)

FOREIGN PATENT DOCUMENTS

| | | | |
|---|---|---|---|
| FR | 2810660 | A1 | 6/2000 |
| GB | 628538 | A | 10/1945 |

*Primary Examiner* — Paul R Durand
*Assistant Examiner* — Donnell Long
(74) *Attorney, Agent, or Firm* — The Watson I.P. Group, PLC; Jovan N. Jovanovic; Vladan M. Vasiljevic

(57) ABSTRACT

A tap for use in association with bag in box containers including a body, a plug member and a drip limiting assembly. The body includes a tap nozzle with a dispensing opening. A nozzle opening is placeable in fluid communication the dispensing opening and with a bag of a bag in box container. The plug member has a second end structurally configured to interface with the dispensing opening and with the plug member. The plug member is selectively actuatable between a closed orientation and an open orientation. In the open orientation, the nozzle opening is in fluid communication with the dispensing opening. In the closed orientation, the nozzle opening is precluded from fluid communication with the dispensing opening. The drip limiting assembly is disposed at the dispensing opening. The drip limiting assembly limits the formation of drips after the plug member is returned to a closed orientation.

4 Claims, 11 Drawing Sheets

(56) References Cited

U.S. PATENT DOCUMENTS 7,240,811 B2 7/2007 Roser
8,104,650 B2 * 1/2012 Lang et al. ..... 222/571
8,109,416 B2 * 2/2012 Morand ..... 222/559

* cited by examiner

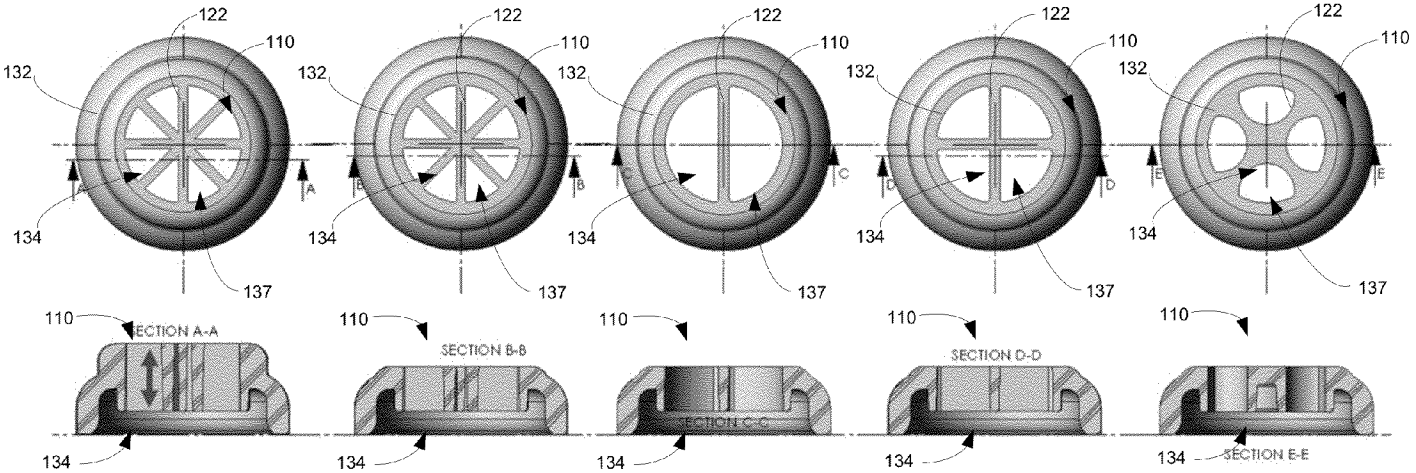
Figure 10a Figure 10b Figure 10c Figure 10d Figure 10e
Figure 10a' Figure 10b' Figure 10c' Figure 10d' Figure 10e'
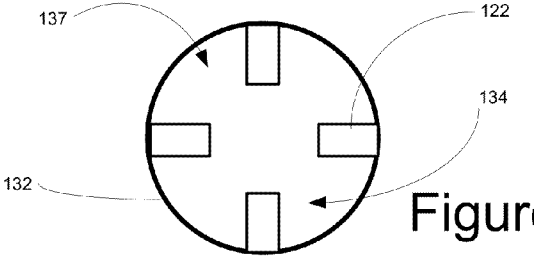
Figure 10f

TAP

CROSS-REFERENCE TO RELATED APPLICATION

This application is a continuation of U.S. patent application Ser. No. 12/769,115, filed Apr. 28, 2010, which is a continuation-in-part of U.S. patent application Ser. No. 12/460,126 filed Jul. 14, 2009, entitled "Tap," the entire disclosure of which is hereby incorporated by reference in its entirety.

BACKGROUND OF THE DISCLOSURE

1. Field of the Disclosure

The disclosure relates in general to fluid delivery taps, and more particularly, to a fluid delivery tap which is configured for use in association with bag in box containers. While not specifically limited to use therewith, the tap has structural features which render it quite useful in association with bag in box containers.

2. Background Art

The use of taps for controlling the dispensing of flowable material from a flexible package, such as a bag are known. Such taps provide a means by which to dispense particular quantities of flowable material. Typically such taps, especially in the bag in box environment are formed from a polymer material. Due to the respective costs of such products, and the fact that they are a single use item, it is necessary to provide a tap that does not leak, that adequately controls dispensing, while minimizing cost.

A number of different taps have been commercially available. One particular segment of the taps has focused on taps that are actuated through rotation of a piston. Such taps are shown in each of U.S. Pat. No. 6,978,981 issued to Roos entitled "Taps for Controlling Liquid Flow" and U.S. Pat. No. 4,619,377 issued to Roos entitled "Tap", the entire disclosures of each of the patents is hereby incorporated by reference in their entirety.

Amongst other deficiencies, the foregoing taps, and especially the tap shown in the '981 patent fail to effectively maintain an upper seal (i.e., above the inlet opening) throughout the movement of the piston within the cylinder bore. Once the tap is opened, the upper seals disengage, and reliance is made upon the interference between the piston and the cylinder bore to preclude leaking A separate drawback to these taps, in addition, is that these taps have lower seals that retain residual fluid. Often after the tap is shut off, the residual fluid collects and drips from the bottom of the tap. When the tap is used with wine, in, for example, a refrigerator, the unsightly drip is often a source of frustration to the user.

It is an object of the present invention to provide a cost effective tap that is adapted for use in association with bag in box packaging.

It is another object of the present invention to provide a tap that is actuated through rotation wherein the upper seal above the inlet is maintained throughout the operational movement of the piston within the cylinder.

It is another object of the present invention to provide a tap that limits the formation of residual fluid, and in turn dripping after the tap is in a closed position.

It is another object of the invention to overcome the deficiencies of the prior art.

These objects as well as other objects of the present invention will become apparent in light of the present specification, claims, and drawings.

SUMMARY OF THE DISCLOSURE

The invention is directed to a tap for use in association with bag in box containers. The tap includes a body, a plug member and a drip limiting assembly. The body includes a tap nozzle with a dispensing opening. A nozzle opening is placeable in fluid communication the dispensing opening and with a bag of a bag in box container. The plug member has a second end structurally configured to interface with the dispensing opening and with the plug member. The plug member is selectively actuatable between a closed orientation and an open orientation. In the open orientation, the nozzle opening is in fluid communication with the dispensing opening. In the closed orientation, the nozzle opening is precluded from fluid communication with the dispensing opening. The drip limiting assembly is disposed at the dispensing opening. The drip limiting assembly limits the formation of drips after the plug member is returned to a closed orientation.

In a preferred embodiment, the drip limiting assembly comprises a plug member drip limiting member having a projection that extends through and beyond the dispensing opening when the plug member is in a closed orientation.

In one such embodiment, the projection comprises one of a frustrum and a conical configuration.

In another such embodiment, the projection has a height and the dispensing opening has a width. The height of the projection is at least equal to the width of the dispensing opening at a widest measurement.

Preferably, the projection has a substantially uniform outer surface configuration.

In a preferred embodiment, the dispensing opening includes a perimeter and a central region within the perimeter. The drip limiting assembly comprises a body drip limiting assembly having a plurality of spaced apart projections extending at least one of downwardly and inwardly from the outer perimeter.

In one such preferred embodiment, the plurality of spaced apart projections extend substantially downwardly in a direction substantially parallel to a flow of flowable material from the dispensing opening.

Preferably, the plurality of spaced apart projections comprise at least six spaced apart projections.

In one embodiment, the spaced apart projections have comprise one of a trapezoidal, a triangular and a rectangular configuration.

Preferably, the spaced apart projections extend substantially inwardly in a direction substantially perpendicular to a flow of flowable material from the dispensing opening so as to extend into the central region.

In one embodiment, the spaced apart projections met in the central region to define at least one chord.

In another embodiment, the spaced apart projections extend into the central region to define at least one sub-opening within the central region of the dispensing opening.

In one such embodiment, the at least one sub-opening comprises a plurality of sub-openings spaced about the central region.

Preferably, the at least one sub-opening comprises a plurality of pie-shaped sub-openings disposed within the central region.

In one embodiment, the at least one sub-opening has a thickness that is less than a width of the dispensing opening.

In one embodiment, the spaced apart projections extend beyond the dispensing opening of the tap.

BRIEF DESCRIPTION OF THE DRAWINGS

The disclosure will now be described with reference to the drawings wherein:

FIGS. 10*a* through 10*f* of the drawings comprise bottom plan views of a number of different shapes and configurations for the spaced apart projections that project in an inward direction and form at least one sub-opening;

FIGS. 10*a*' through 10*e*' of the drawings comprise side elevational views of a number of different shapes and configurations for the spaced apart projections that project in an inward direction and form at least one sub-opening, all corresponding, respectively to FIGS. 12*a* through 10*e;*

DETAILED DESCRIPTION OF THE DISCLOSURE

Figure 1:
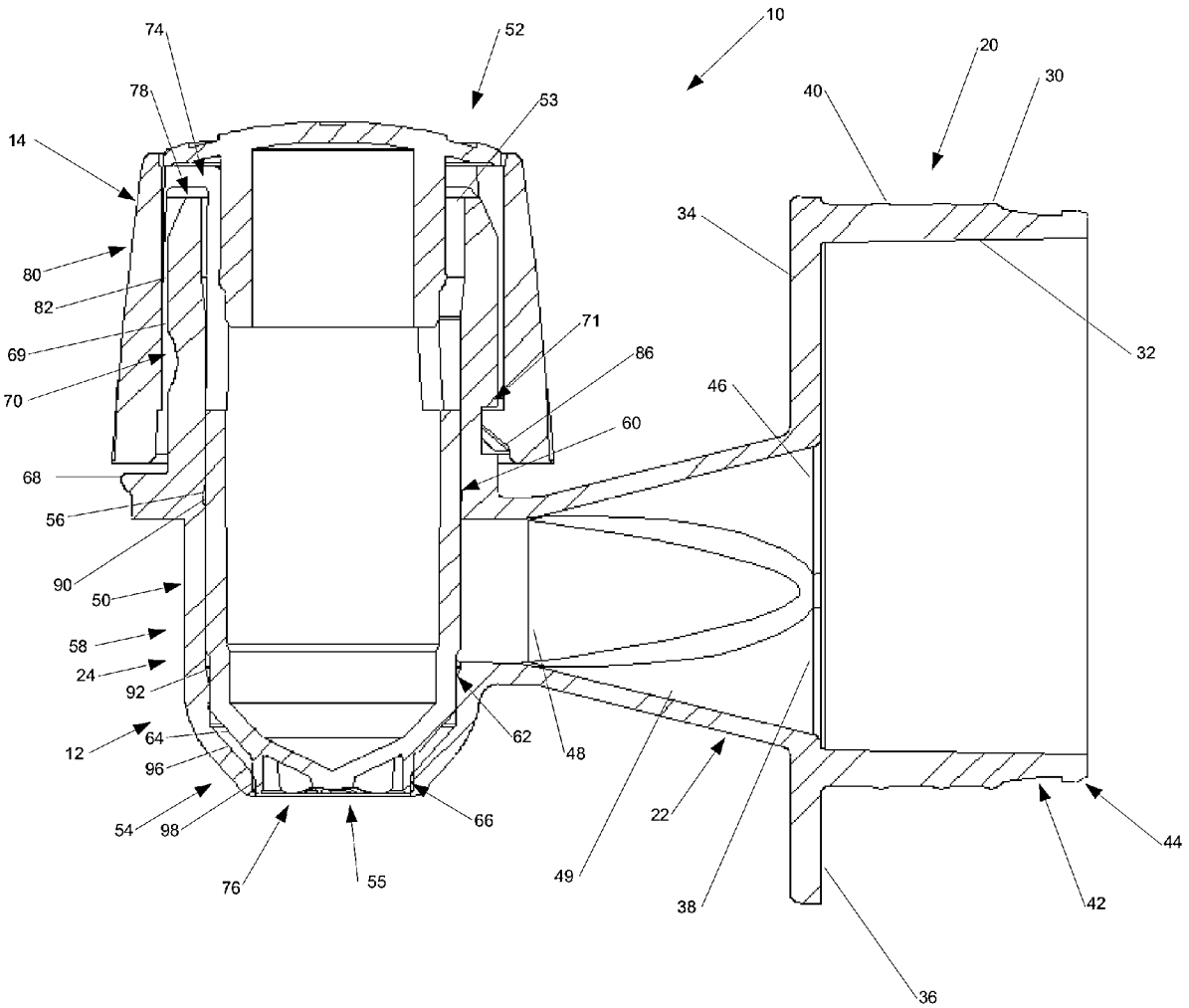
FIG. 1 of the drawings is a cross-sectional view of an embodiment of the tap of the present invention.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the tap of the present invention is shown generally at 10. Tap 10 is configured for use in association with bag in box containers. Such containers are typically utilized for the storage and dispensing of a number of flowable materials, such as, for example, wine products and the like. Such taps must be inexpensive to produce, but must also be able to withstand the rigors of worldwide shipping by air, rail, ship and truck. Additionally, the tap must be able to work reliably to dispense fluid without inadvertent leaking and seeping of the fluid.

The invention is not limited to use in association with wine products, and it will be understood that wine products are merely exemplary. Typically, bag in box containers include a bag having a spout. The bag is typically between 1 liter and 5 liters (although other sizes are likewise contemplated, without limitation). The tap is coupled to the spout of such a bag, and the bag is inserted into the outer box. Generally, the outer box includes an opening through which the tap and spout can extend (and to which they can be coupled).

With further reference to FIG. 1, the tap includes body 12 and plug member 14. The body 12 includes tap barrel 20, tap neck 22 and tap nozzle 24. The body 12 is typically an integrated molded polymer member. Preferably, the tap body comprises a PBT material. Of course, other materials are contemplated for use, such as HDPE or PET, for example. Advantageously, PBT exhibits a substantially lower oxygen transmission rate than HDPE (i.e., up to a fifty fold reduction in oxygen transmission). For certain fluids, such as wine, any reduction in oxygen transmission rates is highly desirable, as oxygen negatively impacts the taste of wine.

With respect to the body, the tap barrel 20 includes outer surface 30, inner surface 32 and front wall 34. The outer surface 30 interfaces with the spout of a bag. Generally the spout of the bag includes an inner bore and an outer surface with a plurality of flanges. Generally a large flange on the outside surface of the spout is sealed to an opening of a bag, thereby providing fluid communication with the contents housed within the bag. The outer surface of the tap barrel includes a plurality of seal beads which interface with the inner bore of the spout to provide a fluid-tight seal. Additionally, a detent 42 and flange 44 are provided. The tap barrel is sized so that when fully inserted into the inner bore of the spout, the flange 44 interfaces with an opposite feature, thereby locking the tap barrel to the spout, and precluding inadvertent disengagement. The detent 42 serves, in part, to define the dimensions of the flange 44.

The front wall 34 of the tap barrel 20 includes front flange 36 and opening 38. The front flange 36 can be used as a location device for automated tap installation equipment and in automated filling equipment (i.e., Form seal fill (FSF) equipment, and the like). In the embodiment shown, the front flange includes a flattened region above the tap neck. Such a configuration allows for the positioning of the tap in a desired orientation within forming and filling equipment. Additionally, the tap nozzle is sized so that it is smaller than the diameter of the front flange, such that the diameter of the front flange is the largest dimension of any member of the tap. The front flange further includes opening 38 to which tap neck 22 is interfaced.

More specifically, tap neck 22 includes barrel opening 46, nozzle opening 48 and inner wall 49. The tap neck provides fluid communication between the opening 38 of the tap barrel and the tap nozzle. The tap neck further separates the tap nozzle from the box housing the bag when in use. As a result, the user can manipulate and operate the tap without having the box in the way of operation. In the embodiment shown, the tap neck tapers from a larger cross-sectional configuration at barrel opening 46 to a smaller diameter at nozzle opening 48. In the particular embodiment, the taper is substantially uniform. Of course, other configurations of the tap neck are likewise contemplated.

The tap nozzle 24 is shown in FIG. 1 as comprising elongated tube 50. The elongated tube 50 includes first end 52, second end 54, inner surface 56 and outer surface 58. An opening is positioned at each of the first end 52 and the second end 54. In particular, handle opening 53 is positioned at the first end 52 and dispensing opening 55 is positioned at the second end 54. The nozzle opening 48 extends into the elongated tube 50 between the first end 52 and the second end 54, thereby providing fluid communication between the elongated tube and, eventually, the inner contents of the bag to which the tap is coupled. The elongated tube, in operation extends substantially vertically, so that the dispensing of fluid through the dispensing opening of the tap nozzle occurs with the assistance of gravity.

The inner surface 56 of the elongated tube 50 includes upper seal surface region 60, lower seal surface region 62, funnel region 64 and lower opening seal 66. Each of the seal surfaces, as will be explained, cooperate with the respective seal bead on the plug member to provide a seal against the passage of fluid thereacross. Dimensionally, in the preferred embodiment, the elongated tube has a substantially cylindrical configuration. The upper seal surface region 60 has a first diameter, the lower seal surface region 62 has a smaller diameter than the upper seal surface region. The funnel region 64 tapers at a decreasing diameter, and finally, the lower opening seal 66 is of lesser diameter than the lower seal surface region. Thus, the three seals comprise successively smaller diameters.

The outer surface 58 includes cap area flange 68 and cam region 69. The cap area flange 68 separates the tap nozzle into an upper portion (having the user articulatable actuator), and a lower portion which comprises the dispenser. The actuator moves vertically in the area above the cap area flange 68. The cam region 69 resides on the outer surface 58 of the tap nozzle 24 above the cap area flange 68.

The cam region 69 includes first cam profile 70 and second cam profile 71. The two cam profiles are positioned on opposing sides of the outer surface. In certain embodiments, the two cam profiles can be replaced with a single cam profile or with more than two cam profiles. The cam profiles are, in the present embodiment, substantially identical and follow a generally downward inclination in a clockwise direction. A tab can be positioned near the upper and lower ends of the cam profile to provide a locking feature. Specifically, a user will require additional force to extend over and beyond the tab, which can then signal that the end of travel in each direction has been reached. Additionally, such a tab provides tactile feedback that the tap has been definitively moved from a closed position toward an open position.

Figure 2:
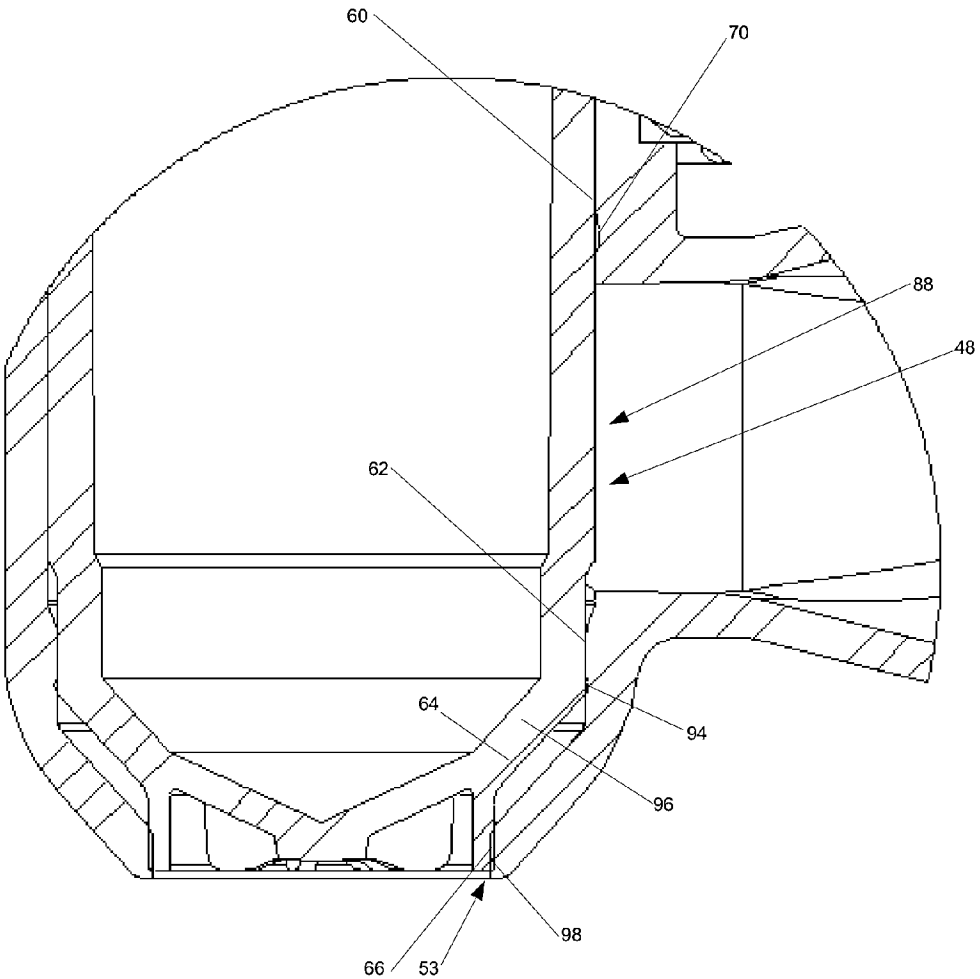
FIG. 2 of the drawings is a partial cross-sectional view of the embodiment of the tap of the present invention.

The plug member 14 is shown in FIG. 1 as comprising first end 74, second end 76, upper flange 78, outer skirt 80 and outer surface 88 (FIG. 2). The plug member is structurally configured to fit within the elongated tube of the body such that the outer surface of the plug member faces the inner surface of the elongated tube, the plug member also structurally configured to be slidably movable within the elongated tube of the body. The fit between the plug member and the elongated tube of the body is on the order of approximately 0.02 mm on either side. Of course, this is merely exemplary, and in certain embodiments, there may be a lesser or greater clearance between the plug member and the elongated tube.

The plug member is preferably made from a material that is different than the material from which the elongated tube is made. Such a configuration further facilitates the sealing engagement of the sealing structures on the respective surfaces. It has been found that a ratio of flexural modulus of the elongated tube relative to the plug member is preferably greater than approximately 1.2. In the preferred embodiment, the plug member comprises a HDPE material, whereas the elongated tube comprises a PBT material. Generally, HDPE has a flexural modulus that ranges between approximately 140,000 psi to 240,000 psi. One particular contemplated HDPE material comprises a 170,000 psi flexural modulus. The PBT flexural modulus has a range between 320,000 PSI and 420,000 PSI. One particular PBT material comprises a 320,000 PSI flexural modulus. For embodiments wherein the elongated tube comprises a PBT material and the plug member comprises and HDPE material, the ratio of the flexural modulus ranges between approximately 1.33 and 3.00. Of course, other material combinations are likewise contemplated, and, it is preferred that the ratio is greater than approximately 1.2.

The first end 74 of the plug member substantially corresponds to the first end of elongated tube 50 of tap nozzle 24 and the second end 76 of the plug member substantially corresponds to the second end of the elongated tube 50 of tap nozzle 24 when in a closed configuration. A rosette can be positioned on the bottom of the plug member at the second end to further aid in the suppression of drips. Additionally, wherein the plug member is hollow and includes an open first end, a cap may be provided to cover the open first end.

The plug member moves within the inside of the elongated tube, and the outer skirt traverses the cam region 69 of the tap nozzle. The outer skirt is joined to the first end of the plug member 14 by way of upper flange 78. The outside of the outer skirt may include a plurality of alternating ridges and valleys to provide additional grip to a user that is manipulating the outer skirt. The outer skirt includes an inner surface 82. A plurality of opposing followers, one of which is shown as follower 86, extend outwardly from the inner surface of the outer skirt toward the outer surface of the plug member 14. These two followers interface with the cam profiles 70, 71, respectively, so that as the plug member is rotated relative to the tap nozzle, the followers interface with the cam profiles to translate the plug member in an upward and downward direction. Of course, it is contemplated that the follower can be placed on the outer surface 58 of the elongated tube 50 and the cam surfaces can be embedded within the inner surface 82 of the outer skirt 80.

The outer surface 88 of the plug member 14 includes upper seal bead 90, lower taper 92, lower seal bead 94, funnel region 96 and drip seal bead 98. The upper seal bead 90 comprises a semi-circular bead that extends about the circumference of the outer seal. The lower seal bead 94 and the drip seal bead 98 have similar configurations (in certain embodiments the drip seal bead may comprise a barrel in barrel seal, wherein the bead may comprise the entire dimensional area). The upper seal bead 90, when the plug member 14 is installed within the tap nozzle, interfaces with the upper seal surface region 60 to provide a fluid tight seal, and to define an upper seal assembly. The upper seal bead 90 has a diameter that is slightly larger than the diameter of the upper seal region 60 so that the upper seal surface region 60 inwardly biases and directs the upper seal bead 90 so as to provide a substantially leak proof barrier. For example, it is contemplated that the interference between the upper seal bead and the upper seal region is approximately between 0.07 mm and 0.11 mm, on each side, most preferably. Of course, the particular interference can be varied depending on the resistance that is desired to rotation of the plug member, the materials selected, the type of fluid dispensed, among other considerations. In the embodiment shown, the upper seal bead 90 remains in contact with the upper seal surface region 60 throughout the operative range of the plug member relative to the tap nozzle.

In the embodiment shown, the upper seal surface region 60 has a substantially uniform diameter so that the inward biasing force exerted upon the upper seal region 60 remains substantially uniform throughout the operative range. In other embodiments, the diameter of the upper seal surface region 60 can be varied throughout the operative range. For example, the diameter of the upper seal region 60 can be uniformly increasing as the tap is opened. In such an embodiment, the user will feel greater resistance to movement as the tap gets closer to the closed orientation, and less resistance to movement as the tap gets closer to the open orientation. In another embodiment, the upper seal region 60 may include areas of smaller diameter at either end of the operative range so that an increase in resistance is realized when the tap reaches the fully closed or the fully open orientation. In summary, along the length of the operative range of the upper seal system, the interference can be varied between certain limits, to alter the resistance to movement.

Figure 4:
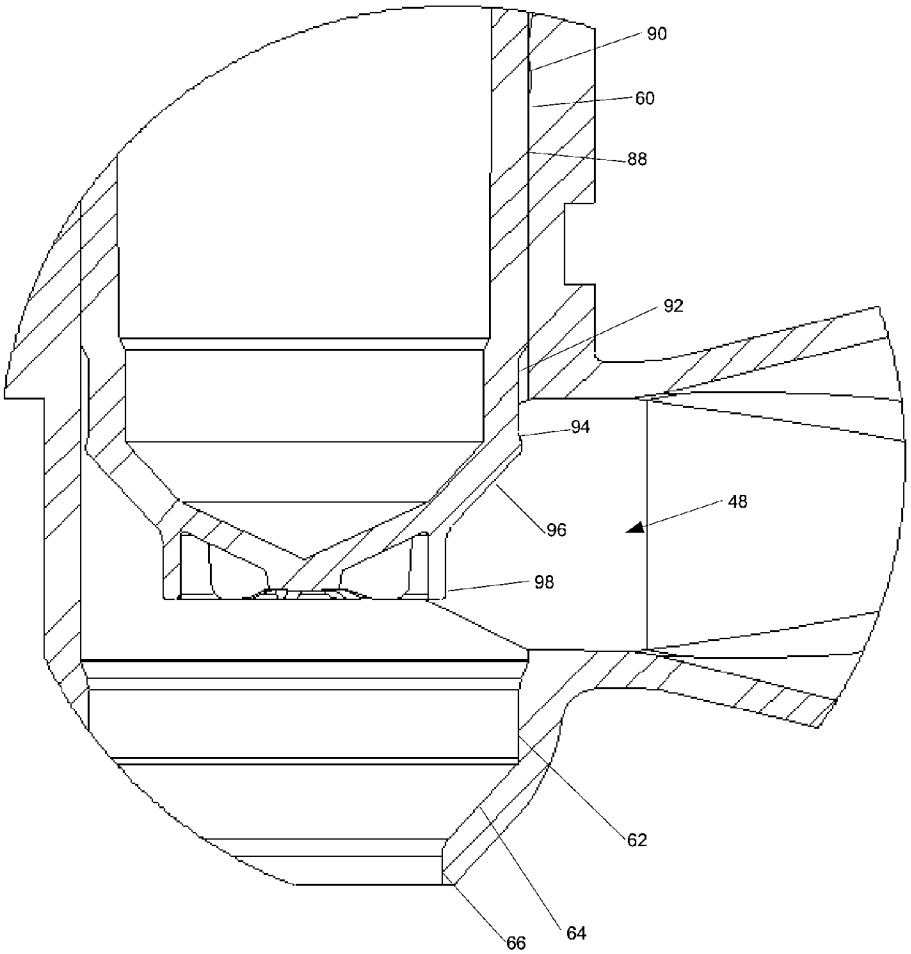
FIG. 4 of the drawings is a partial cross-sectional view of the embodiment of the tap of the present invention.
Figure 5A:
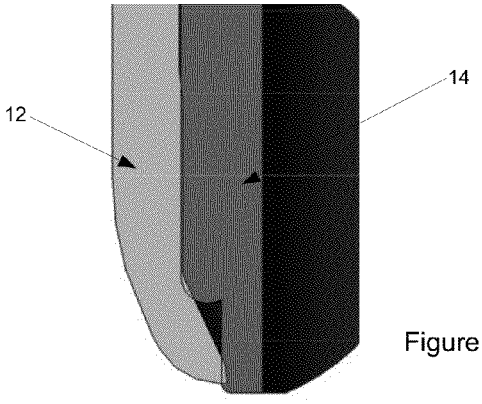
FIGS. 5*a* through 5*e* of the drawings comprise a partial cross-sectional view of a number of different lower seals which can be cooperatively coupled in a tap with the top seal of the embodiment of FIG. 1.
Figure 5B:
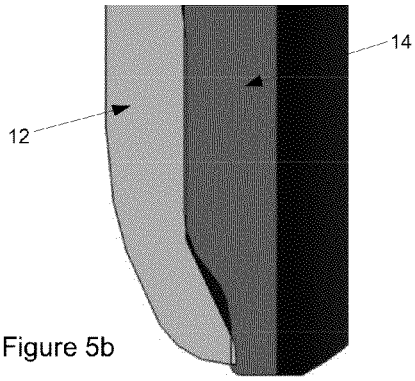
Figure 5C:
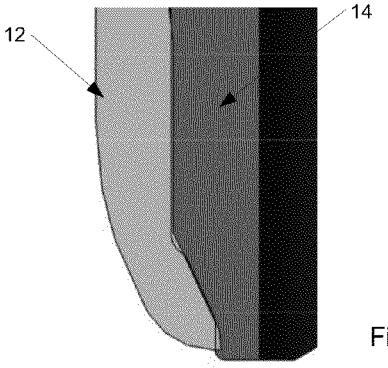
Figure 5D:
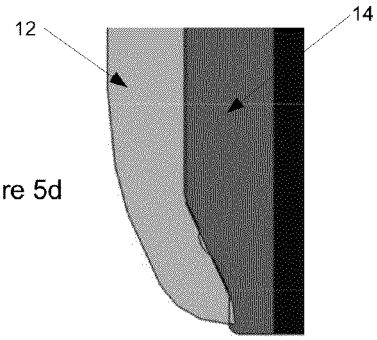
Figure 5E:
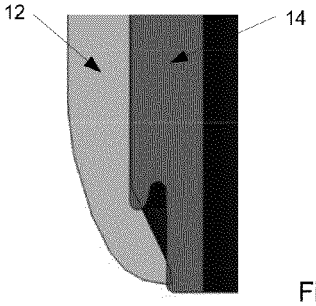

With additional reference to FIGS. 2 and 4, the lower seal bead 94 is configured to interface with the lower seal surface region 62. As with the upper seal, the lower seal bead 94 has a larger diameter than the lower seal surface region 62 such that when abutting, the lower seal surface region 62 applies a biasing force against the lower seal bead 94 to provide a fluid tight configuration, and thereby defining a lower seal assembly. As with other seals, it is contemplated that the interference between the lower seal bead and the lower seal region is approximately between 0.07 mm and 0.11 mm, most preferably (without limitation). The lower seal surface 62 has a diameter that is smaller than the upper seal region 60, and the lower seal surface 62 terminates short of the operation range of the plug member relative to the tap nozzle. As such, once the tap is opened a certain amount, the lower seal bead 94 extends beyond the lower seal surface 62 and is separated from the inner surface 56 of the elongated tube 50 of the tap nozzle 24.

In the embodiment shown, the lower seal surface 62 terminates below the nozzle opening 48. As will be explained in detail below with respect to the operation, as the user rotates and translates the plug member from a closed position to the open position, the lower seal bead 94 is separated from the inner surface of the tap nozzle prior to traversing beyond the nozzle opening 48, thereby improving the control of the flow when the flow of fluid is initiated and when it is closed, and allows for an improved ramp up and ramp down to the flow of fluid and limits spiking of fluid flow.

The drip seal bead 98 interfaces with the pour opening 66. As with the other seals, the drip seal bead 98 has a diameter that is larger than the pour opening 66. In turn, the pour opening directs the drip seal bead 98 in an inward direction, to, in turn, provide a substantially fluid tight seal, and thereby define a bead seal assembly. As with the other seals, the interference between the seal components is approximately between 0.07 mm and 0.11 mm, most preferably (without limitation). The drip seal bead 98 is positioned in close proximity to the end of the second end 76 so that the interface can be as close to the pour opening as possible, to, in turn, limit any residual dripping once the lower seal bead 94 interfaces with the lower seal surface region 62. In certain embodiments, the drip seal bead can be eliminated, instead relying on the sealing properties of the lower seal bead against the lower seal surface region. In such a configuration, the outer surface of the plug member and the inner surface 56 of the tap nozzle proximate the second end interfere with each other, but no substantial deflection or substantially fluid tight sealing takes place.

Figure 3:
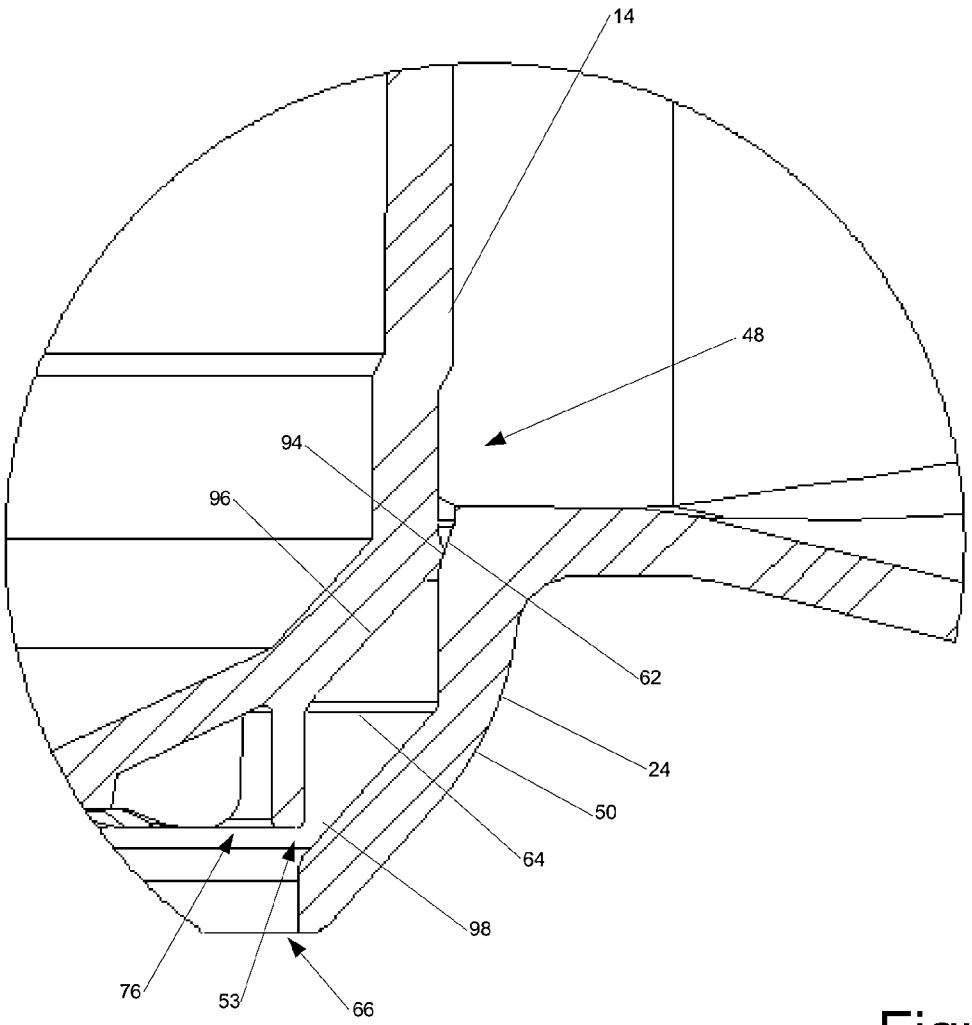
FIG. 3 of the drawings is a partial cross-sectional view of the embodiment of the tap of the present invention.

Preferably, in the closed position, the funnel region 64 of the tap nozzle 24 and the funnel region 96 of the plug member remain separated when the tap is in the fully closed orientation. Of course, in other embodiments, these surfaces may be in contact so as to provide additional sealing surfaces. With additional reference to FIG. 3, it will be understood that in the closing sequence, the lower seal bead 94 of the plug member sealingly engages the lower seal surface region 62 prior to the engagement of the drip seal bead 98 with the lower opening 66. This allows for any residual fluid that is trapped below the lower seal bead 94 to flow out of the tap prior to engagement of the drip seal bead 98. Such a configuration greatly decreases the undesirable dripping as the tap is closed and residual drips after dispensing is completed, and substantially diminishes the possibility of what is known in the wine dispensing industry as spitting.

In other embodiments, the lower seal can be altered in configuration, while retaining the disclosed upper seal configuration. In each such embodiment, shown in FIGS. 5*a* through 5*e*, the elongated tube lower seal surface region and pour region (where incorporated) direct the respective one of the lower seal bead and the drip seal bead in an inward direction. In still other embodiments, a thin walled portion proximate one or both of the beads can facilitate the inward movement of the respective valve seat. In other embodiments, the valve seat may comprise a dependent skirt which can be flexed inwardly by the cylindrical tube assembly. In still other embodiments, while retaining the upper seal disclosed herein, it will be understood that the lower seals can be replaced with a lower seal such as is disclosed in either one of U.S. Pat. No. 6,978,981 issued to Roos entitled "Taps for Controlling Liquid Flow" and U.S. Pat. No. 4,619,377 issued to Roos entitled "Tap", the entire disclosures of each of the patents is hereby incorporated by reference in their entirety.

Other modifications within the scope of the invention are likewise contemplated. For example, and not to be deemed limiting, the orientation of the seal surface regions can be swapped with the orientation of the seal beads for each of the upper, lower and pour seal assemblies, so that the beads are located on the inner surface of the elongated tube and the seal surfaces are located on the outer surface of the plug member.

The operation of the tap will be described with respect to a wine bag in box embodiment, with the understanding that the tap is not limited to such an environment or to such a fluid. The environment selected is a significant environment where ease of operation, cost and function are highly significant. In such an environment, a bag is selected and filled with the desired fluid. The tap is coupled to the spout of such a bag. As explained, above, to couple the tap to the spout, the tap is inserted into the inner bore of a spout until the flange 44 extends beyond the inner bore and interfaces with the corresponding structure on the inner surface of the spout and is captured thereby. The tap is then locked in position and substantial force is required to disconnect the tap from the spout. The remaining seal beads 40 on the outer surface 30 sealingly interface with the inner bore to, in turn, provide a fluid tight configuration.

The filled bag and tap are inserted into a box. Typically, such a box includes a frangible portion which can be removed to define an opening in the box. The tap can be extended through this opening and one of the spout and the tap can be coupled to the box at the opening.

When the user is ready to dispense the fluid, the user grasps the outer skirt 80 and rotates the outer skirt in a first direction (conventionally, a counter clockwise direction). Rotation of the outer skirt begins a number of simultaneous or successive events. In particular, the followers are guided by the cam surfaces to translate the plug member relative to the tap nozzle in an upward direction. As the plug member moves in an upward direction, the drip seal bead 98 separates from the pour opening. At the same time, the lower seal bead 94 sealingly translates against the lower seal surface region 62, and, the upper seal bead 90 translates against the upper seal surface region 60. Upon continued rotation, the lower seal bead 94 separates from the lower seal surface region 62. Due to the configuration of the nozzle opening and the lower seal surface region the nozzle opening 48 is placed in fluid communication with pour opening 66 and fluid begins to flow out of the tap.

Continued rotation of the skirt in the first direction further moves the plug member upwardly exposing successively greater portions of the nozzle opening. This continues until the second end of the cam surfaces is reached and the cam precludes further rotative movement of the plug member. Throughout the range of movement, the upper seal bead 90 remains sealingly engaged with the upper seal surface region 60.

When the user wants to stop flow of the fluid from within the container, the user rotates the outer skirt in a second direction (conventionally, a clockwise direction). As the outer skirt is rotated, the plug member is directed in a downward direction. Through continued movement, the lower seal bead 94 proceeds beyond the nozzle opening gradually reducing flow through the pour opening. Eventually, continued rotation directs the lower seal bead 94 into contact with the lower seal surface region 62 sealing the nozzle opening 48 from the pour opening.

While the flow of fluid from the nozzle opening has stopped, residual fluid remains between the lower seal bead 94 and the pour opening. Advantageously, even though the lower seal bead 94 has sealingly engaged the lower seal surface region 62, the funnel regions 64, 96 remain separated as does the drip seal bead 98 and the pour opening 66. Thus, the residual fluid is permitted to exit the tap. Continued rotation of the outer skirt further translates the plug member until the drip seal bead 98 engages the pour opening 66. During this movement, the funnel regions (which together effectively define a residual volume), get closer to each other successively reducing the residual volume within the tap below the lower seal bead 94 (which further expels any residual fluid). Thus, inadvertent drips can be virtually eliminated.

Eventually, the followers reach the first end of the cam surfaces, and the cam surfaces provide a barrier against further movement of the plug member relative to the tap nozzle. In the fully closed position, it is advantageous that the top flange remain separated from the first end of the tap nozzle and that the bottom of the skirt be separated from the cap area flange. This permits full travel of the followers and insures that the cam and follower configuration fully controls the movement of the plug member relative to the tap nozzle.

With reference to FIGS. 6*a* through 11*c*, it will be understood that the tap of the present disclosure, as well as other taps that rely on a plug member for the control of dispensing of product, such as, for example, and without limitation, the patents of Roos set forth and incorporated above, as well as the taps of Erb, namely, U.S. Pat. No. 6,045,119 and U.S. Pat. No. 6,296,157, as well as the tap shown in U.S. Pat. No. 7,240,811 issued to Roser, can be augmented with a drip limiting assembly 110. The drip limiting assembly is a cost effective assembly which is configured to limit the dripping from a tap. Each of the foregoing patent applications are incorporated by reference herein in their respective entirety.

Figure 6A:
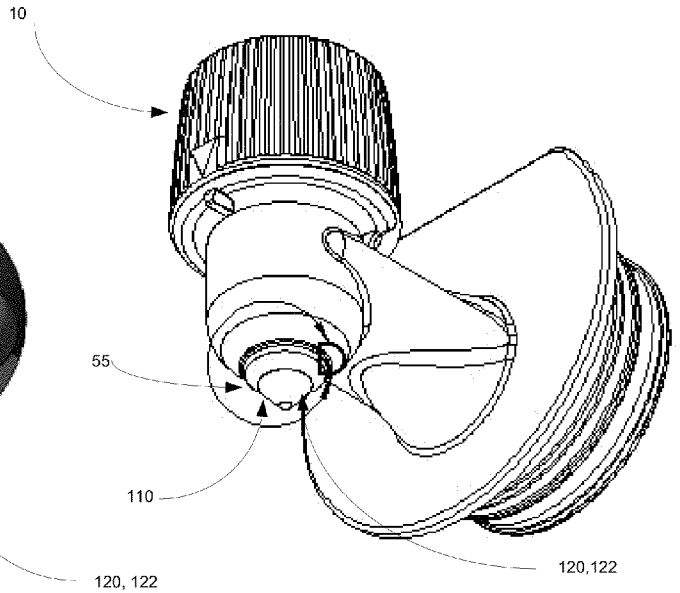
FIG. 6*a* of the drawings is a perspective view of an embodiment of the tap of the present invention, showing, in particular, the plug member drip limiting assembly.
Figure 6B:
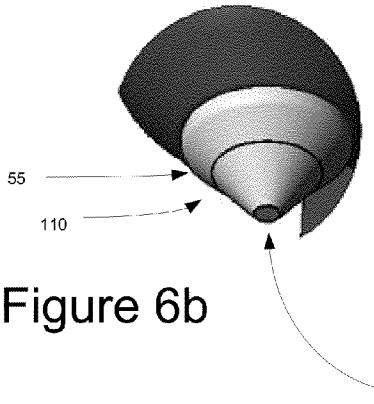
FIG. 6*b* of the drawings is an enlarged partial perspective view of an embodiment of the tap of the present invention, showing, in particular, the plug member drip limiting assembly.
Figure 6C:
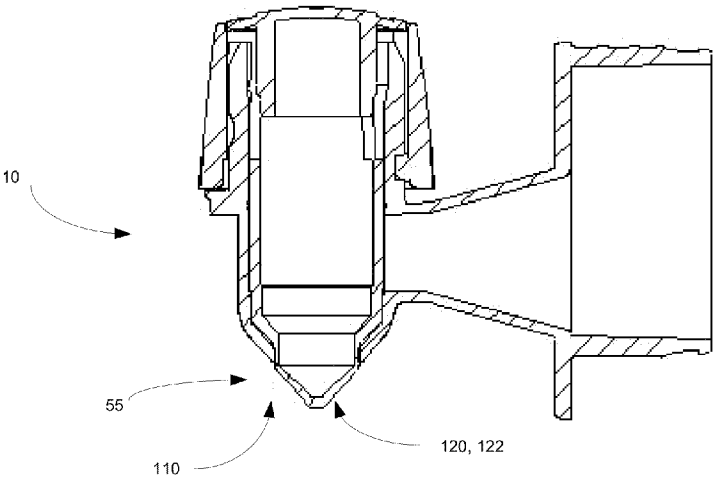
FIG. 6*c* of the drawings is a cross-sectional view of an embodiment of the tap of the present invention, showing in particular, the plug member drip limiting assembly.
Figure 7B:
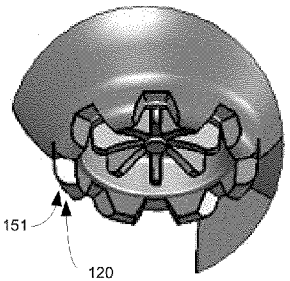
FIG. 7*b* of the drawings is an enlarged partial perspective view of an embodiment of the tap of the present invention, showing, in particular, the body drip limiting assembly.
Figure 7A:
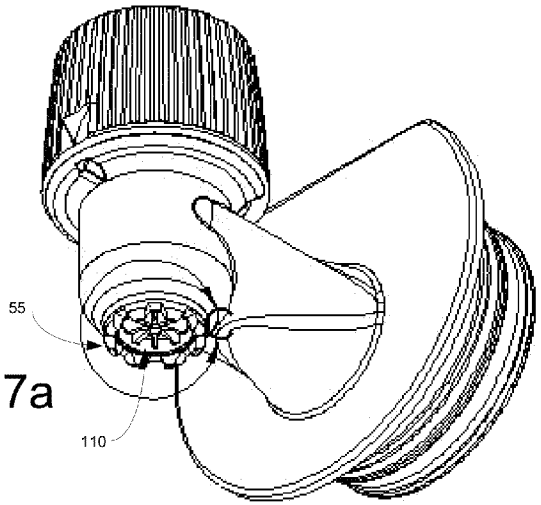
FIG. 7*a* of the drawings is a perspective view of an embodiment of the tap of the present invention, showing in particular, the body drip limiting assembly.
Figure 7C:
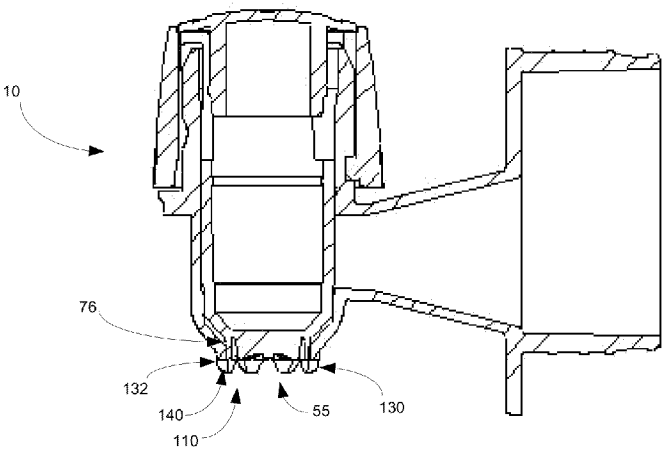
FIG. 7*c* of the drawings is a cross-sectional view of an embodiment of the tap of the present invention, showing in particular, the body drip limiting assembly.
Figure 8B:
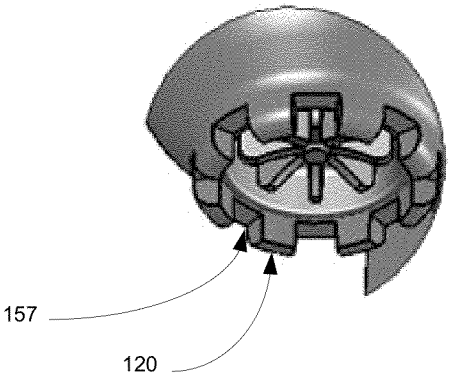
FIGS. 8*a* and 8*b* of the drawings comprise side elevational views of a plurality of different shapes and configurations for the spaced apart projections that project in a downward direction.
Figure 8A:
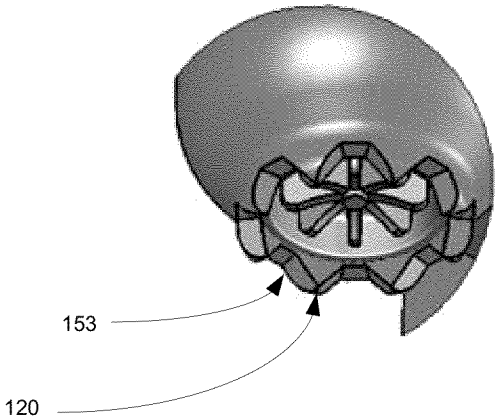

In one embodiment, and with respect to FIGS. 6*a* through 6*c*, collectively, the drip limiting assembly 110 is configured and formed with the plug member drip limiting member 120. The plug member drip limiting assembly comprises at least one projection, such as projection 122 which extends beyond the second end of the plug member when the plug member is in the closed orientation. In the embodiment shown, the projection 122 comprises a conical member tapering in the outward direction to a point (conical) or to a flattened surface (frustum). The conical member may have a continuous surface configuration and preferably comprises a right circular cone. The height of the conical member is approximately the largest width (i.e., diameter) of the dispensing opening 55, although both conical members of greater or lesser height are contemplated. In other embodiments, the surface may be configured differently, and may resemble frusta of different cross-sectional configurations (i.e., pentagonal, square, octagonal frusta and the like).

In operation, for such an embodiment, as the user returns the plug member into a position that stops the flow of flowable material through the dispensing opening, any remaining fluid tends to slide down the projection to the tip thereof, and then drips into the container (i.e., cup, glass, bottle, etc.) positioned therebelow. The projection is efficient at eliminating the drips quickly and very little residual flowable material remains on the projection or in any area around the dispensing opening. Thus, no additional drips form after the user has removed the container.

In another embodiment, and with reference to FIGS. 7*a* through 9, the drip limiting assembly 110 comprises structures that are extensions of or coupled to the body. In particular, the drip limiting assembly 110, with reference to FIGS. 7*a* through 7*c*, collectively, comprises a body drip limiting assembly 130. The body drip limiting assembly 130, in one embodiment, comprises a plurality of spaced apart projections 140 that extend downwardly and/or inwardly from outer perimeter 132 of the dispensing opening 55. For example, and with reference to FIGS. 7*b*, 8*a* and 8*b*, a plurality of trapezoidal 151, triangular 153, and rectangular 157 projections are shown. These are spaced around the outer perimeter 132 of the dispensing opening 55. The foregoing shapes are for illustrative purposes and are not to be deemed limiting (i.e., other shapes, including arcuate and arbitrary shapes are contemplated). The projections extend beyond the reach of the second end of the plug member 76 so that they are projecting in a downward and/or inward direction beyond the second end of the plug member.

Figure 9A:
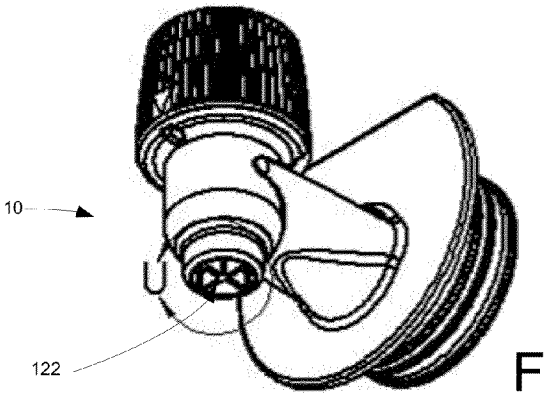
FIG. 9*a* of the drawings is a perspective view of an embodiment of the tap of the present invention, showing in particular the body drip limiting assembly.
Figure 9B:
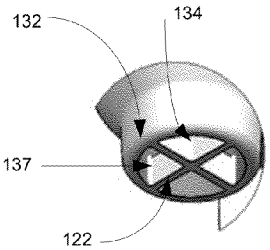
FIG. 9*b* of the drawings is an enlarged perspective view of an embodiment of the tap of the present invention, showing in particular, the body drip limiting assembly.
Figure 9C:
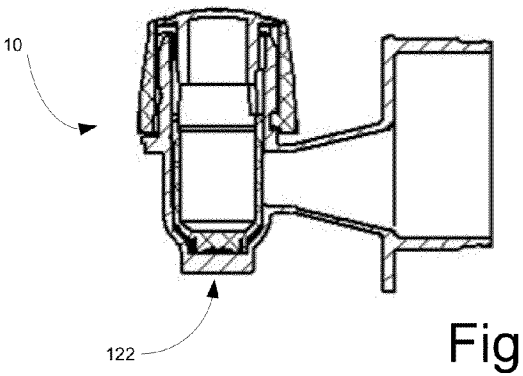
FIG. 9*c* of the drawings is a cross-sectional view of an embodiment of the tap of the present invention, showing in particular, the body drip limiting assembly.

With reference to FIGS. 9*a* through 9*c*, in certain embodiments, the projections 122 may be coupled together at the distal ends thereof, so as to extend into the central region 134 of the dispensing opening defined by the outer perimeter 132. In certain embodiments, a number of the projections 122 may be linked together to, for example, form a plurality of chords that extend across the central region 134 of the dispensing opening. For example, in the embodiment of FIGS. 9*a* through 9*c*, two pairs of projections meet in the center of the central region to, in turn, define four pie shaped sub-openings 137 (which is also shown in FIGS. 10*d*, 10*d*'). In other embodiments, the projections can be non-uniform and can define a plurality of different shapes within the central region. In each instance, the projections interact with each other to define a plurality of sub-openings 137 which are each smaller than the dispensing opening.

A number of different configurations are shown in the figures, for illustrative purposes, and are not deemed to be limiting the disclosure to the embodiments shown. More specifically, in FIGS. 10*a* and 10*a*', show a plurality of projections 122 intersecting generally at the center of the central region to define eight substantially identical pie-shaped sub-openings 137. In FIGS. 10*b* and 10*b*', the projections are substantially identical to those of FIGS. 10*a* and 10*a*' with the exception that the projections are approximately half the thickness of those of FIGS. 10*a* and 10*a*'. In FIGS. 10*c* and 10*c*', a pair of projections extend across the central region to define a chord that extends through the center of the central region and defines two semi-circular sub-openings 137. In FIGS. 10*d* and 10*d*', which is similar to that which is shown in FIGS. 9*a* through 9*c*, two pairs of projections meet in the center of the central region to, in turn, define four pie shaped sub-openings 137. In FIGS. 10*e* and 10*e*', non-linear projections meet generally in the center of the central region, to, in turn, define a plurality of compound arcuate sub-openings 137 which are equally spaced about the central region. Generally, the thickness of the projections is substantially less than the diameter of the dispensing opening. Finally, in FIG. 10*f*, four substantially identical projections extend inwardly within the central region but do not contact each other, defining a single sub-opening 137 within the central region 134.

Figure 11A:
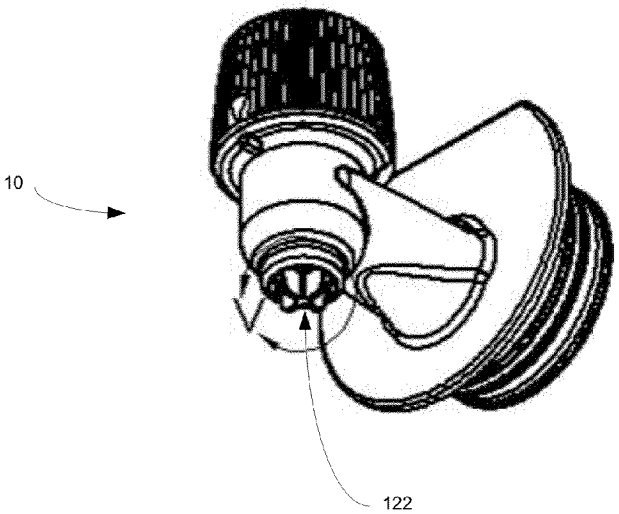
FIG. 11*a* of the drawings is a perspective view of an embodiment of the tap of the present invention, showing in particular the body drip limiting assembly.
Figure 11B:
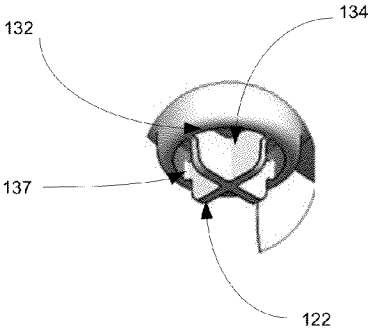
FIG. 11*b* of the drawings is an enlarged perspective view of an embodiment of the tap of the present invention, showing in particular, the body drip limiting assembly.
Figure 11C:
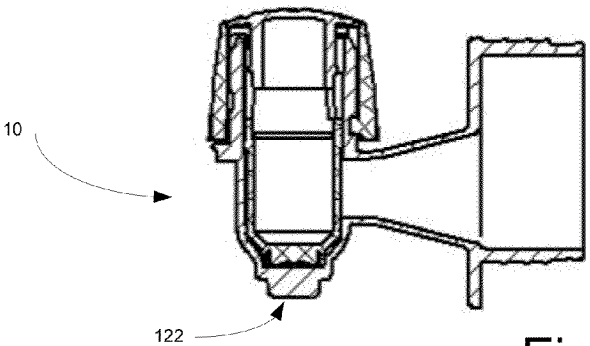
FIG. 11*c* of the drawings is a cross-sectional view of an embodiment of the tap of the present invention, showing in particular, the body drip limiting assembly.

With reference to FIGS. 11*a* through 11*c*, the projections can extend beyond the dispensing opening 55 of the second end. In particular, these projections. The projections start within the tap nozzle and extend well beyond the opening 55 wherein the projections terminate beyond the opening 55. Such a configuration, it has been shown further reduces the formation of a drip. It will be understood that a number of configurations shown in FIGS. 10*a* through 10*e* are suitable in such an embodiment.

It will be understood that the projections may be integrally molded with the body into a single molded member. In other embodiments, a ring can be coupled or mated to the second end of the body so that it interfaces with the outer perimeter of the dispensing opening and overlies the dispensing opening itself. Typically the projections are spaced apart from the second end of the plug member by a predetermined distance when the plug member is in a closed orientation.

In operation of such an embodiment, as the user directs the plug member back to a closed orientation wherein the second end of the plug member interfaces with the second end of the elongated tube, thereby stopping the flow, any residual that is at or near the dispensing opening interfaces with the projections 122, dispersing into ever smaller droplets. With the surface area associated with the projections 122, any residual fluid is spread out over a relatively large surface area, and drops of flowable material of sufficient mass do not develop. As such, even after considerable time, a drop of sufficient mass to drip does not form. The disruptive shapes of the downward and/or inward (i.e., substantially parallel to the flow and/or substantially perpendicular to the flow) break up drip formation and do not allow the formation of a drip of sufficient mass. It will be understood that the disruptive shapes can be sloped both downwardly and inwardly, however, typically, the disruptive shapes will be angled so that they a larger component is in either a downward or an inward direction (of course, a configuration can be achieved which is angled at approximately 45° relative to the flow so that it is as downward as it is inward).

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A tap for use in association with bag in box containers comprising:

a body having a tap nozzle with a dispensing opening and a nozzle opening placeable in fluid communication with the dispensing opening and with a bag of a bag in box container;

a plug member having a second end structurally configured to interface with the dispensing opening and with the plug member being selectively actuatable between a closed orientation and an open orientation, wherein in the open orientation, the nozzle opening is in fluid communication with the dispensing opening and wherein in the closed orientation the nozzle opening is precluded from fluid communication with the dispensing opening; and a drip limiting assembly disposed at the dispensing opening beyond the lowermost position of the plug member and extending away therefrom to, in turn, limit the formation of drips after the plug member is returned to a closed orientation, wherein the dispensing opening includes a perimeter and a central region within the perimeter, defining a cross-sectional area, the drip limiting assembly comprises a body drip limiting assembly integrally molded with the body, having a plurality of spaced apart projections extending downwardly from the outer perimeter collectively defining a substantially uniform projection cross-sectional area therealong, and wherein a first portion of the dispensing opening along which the plug member interfaces is substantially uniform in cross-sectional area, with a second portion below a lowermost position of the plug member being of a cross-sectional area that is the same as or smaller than the first portion, and the projection cross-sectional area being the same as or smaller than the second portion.

2. The tap of claim 1 wherein the plurality of spaced apart projections extend substantially downwardly in a direction substantially parallel to a flow of flowable material from the dispensing opening, so as to define a substantially cylindrical dispensing cross-sectional area having a uniform cross-sectional configuration therealong.

3. The tap of claim 2 wherein the plurality of spaced apart projections comprise at least six spaced apart projections.

4. The tap of claim 2 wherein the spaced apart projections comprise one of a trapezoidal, a triangular and a rectangular configuration.

* * * * *